US005718009A

United States Patent [19]

Lin

[11] Patent Number: 5,718,009

[45] Date of Patent: Feb. 17, 1998

[54] CONTINUOUS BEDCLOTHES APPARATUS

[76] Inventor: Yi Chang Lin, 5F-2,No.11,Tzu Li 1stRd., Kaohsiung, Taiwan

[21] Appl. No.: 600,258

[22] Filed: Feb. 12, 1996

[51] Int. Cl.[6] ..... A47C 21/02

[52] U.S. Cl. ..... 5/487; 5/488; 5/498

[58] Field of Search ..... 5/487, 488, 498, 5/504.1, 503.1, 658

[56] References Cited

U.S. PATENT DOCUMENTS

| | | | |
|---|---|---|---|
| 1,693,022 | 11/1928 | Chapman | 5/498 |
| 1,877,610 | 9/1932 | Steiner | 5/488 |
| 1,967,422 | 7/1934 | Nadelson | 5/488 |
| 2,130,268 | 9/1938 | Craddock | 5/498 |
| 4,025,973 | 5/1977 | Walbrecht | 5/488 |
| 5,084,927 | 2/1992 | Parkevich | 5/487 |

FOREIGN PATENT DOCUMENTS

| | | | |
|---|---|---|---|
| 2428997 | 2/1980 | France | 5/488 |
| 596539 | 11/1935 | Germany | 5/488 |
| 2526 | 6/1985 | WIPO | 5/487 |

*Primary Examiner*—Flemming Saether

*Attorney, Agent, or Firm*—David & Raymond; Raymond Y. C. Chan

[57] ABSTRACT

A continuous bedclothes apparatus includes a continuous bedclothes device which includes an elongated sheet and a delivery roller. The long sheet is made of disposable and recyclable material and one end of the sheet is attached to the delivery roller. The sheet is rolled on the delivery roller and has a plurality of transversal dividing lines parallelly and evenly positioned along the length of the sheet respectively. The dividing lines divide the elongated sheet into a plurality bedclothes units of same width. The continuous bedclothes device further comprises a delivery device including a housing and a pair of supporting axles. The housing has a delivery slit adapted for the delivery of the sheet via the delivery slit and the pair of supporting axles are affixed to two opposite sides of the housing so as to support the delivery roller in rotary manner and parallel to the delivery slit. Accordingly, the continuous bedclothes apparatus can be applied for bed coveting of public residence, such as hotels, motels, lodges, and hospitals, to improve the quality and hygiene of bedclothes equipment and reduce the cost of operations by using continuously disposable and recyclable bedclothes material.

2 Claims, 18 Drawing Sheets

CONTINUOUS BEDCLOTHES APPARATUS

BACKGROUND OF THE PRESENT INVENTION

The present invention relates to bedclothes, such as bedcovers, bedspreads or bedsheets, and more particularly to a continuous bedclothes apparatus which can continuously feed disposable and recyclable bedclothes for bed setting.

In the common practice, the personal items provided by the hotels and motels such as tooth-paste, toothbrushes, shampoo, soap, slippers, etc., are disposable. However, there has been little improvement to the bedclothes, such as bedcovers, bedspreads and bedsheets, which are very important to personal hygiene because these items come into direct contact with the bodies of people. Customers of hotel or patients of hospital usually worry about contagious diseases and if the bedclothes are completely sanitized or not even the reusable bedclothes of high quality cloth materials have been frequently washed elaborately.

On the other hand, the cost of maintaining sanitary bedclothes is generally high. When such cost includes salaries and wages, deprecations of washing machines, dryers and related equipment, water and electricity bills, and maintenance expenses, it will take up at least 60% of the total cost of operations for lodging business.

For the bedclothes of hospital, the blood stains are very difficult to clear away. However, human blood is a well known AIDS medium that most patients are very concerned about the sanitation of bedclothes.

SUMMARY OF THE PRESENT INVENTION

The main object of the present invention is to provide a continuous bedclothes apparatus for bed coveting of public residence, such as hotels, motels, lodges, and hospitals, to improve the quality and hygiene of bedclothes equipment and reduce the cost of operations by using continuously disposable and recyclable bedclothes material.

Another object of the present invention is to provide a continuous bedclothes apparatus which comprises a delivery and receiving device incorporated with a continuous bedclothes device for enabling the continuous bedclothes device to conveniently set on a bed and changed after use.

A continuous bedclothes apparatus includes a continuous bedclothes device which includes an elongated sheet and a delivery roller. The elongated sheet is made of disposable and recyclable material and one end of the elongated sheet is attached to the delivery roller. The elongated sheet is rolled on the delivery roller and has a plurality of transversal dividing lines parallelly and evenly positioned along the length of the elongated sheet respectively. The dividing lines divide the elongated sheet into a plurality of bedclothes units of same width. The continuous bedclothes device further comprises a delivery device including a housing and a pair of supporting axles. The housing has a delivery slit adapted for delivering the elongated sheet via the delivery slit and the pair of supporting axles are affixed to two opposite sides of the housing so as to support the delivery roller in rotatable manner and parallel to the delivery slit. Accordingly, the continuous bedclothes apparatus can be applied for bed covering of public residence, such as hotels, motels, lodges, and hospitals, to improve the quality and hygiene of bedclothes equipment and reduce the cost of operations by using continuously disposable and recyclable bedclothes material.

DETAILED DESCRIPTION OF THE EMBODIMENT

Figure 1:
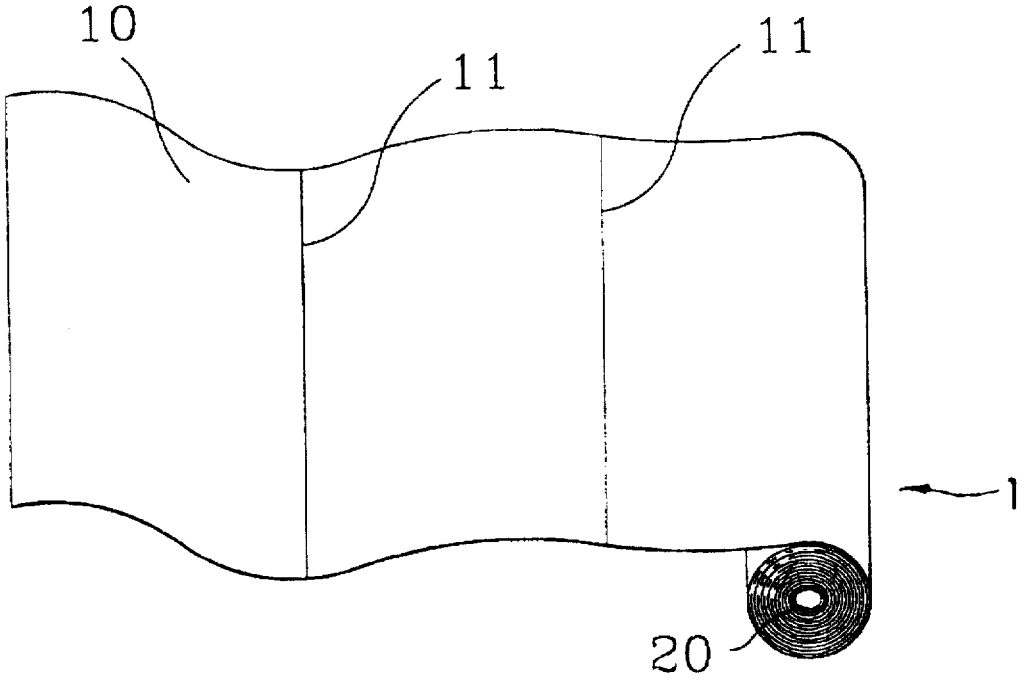
FIG. 1 is a perspective view of a continuous bedclothes device of a continuous bedclothes apparatus according to a preferred first embodiment of the present invention.

Referring to FIGS. 1 to 4 of the drawings, a continuous bedclothes apparatus according to a first embodiment of the present invention is illustrated. The continuous bedclothes apparatus comprises a continuous bedclothes device 1 which includes an elongated sheet 10 and a delivery roller 20. The long sheet 10 is made of disposable and recyclable material such as durable elastic paper, knitting tissue, compressed tissue or paper clothe, etc. and has a width equal to the length of the delivery roller 20. One end of the sheet 10 is attached to the delivery roller 20 and the sheet 10 is rolled on the delivery roller 20. The sheet 10 has a plurality of transversal dividing lines 11 parallelly and evenly positioned along the length of the sheet 10 respectively. The dividing lines 11 divide the elongated sheet 10 into a plurality bedclothes units of same width, each unit having a size adapted to fully cover a mattress 40 of a bed for acting as a bedsheet.

Figure 2:
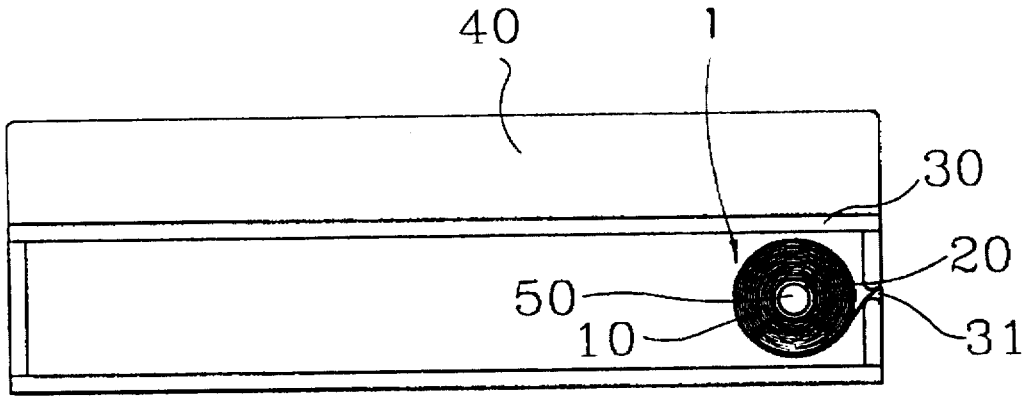
FIG. 2 is a perspective elevation view the above first embodiment of the present invention, illustrating the disposition of the continuous bedclothes device within a bedstead housing.

The continuous bedclothes device 1 further comprises a delivery device including a housing 30 and a pair of supporting axles 50. The housing has a delivery slit 31 adapted for the delivery of the sheet 10 via the slit 31. The pair of supporting axles 50 are affixed to two opposite sides of the housing 30 so as to support the delivery roller 20 in rotary manner and parallel to the slit 31, as shown in FIG. 2. Such housing 30 can be fit into the space within a bedstead or acting as the bottom bedstead of the mattress 40, wherein the delivery slit 31 is formed at the bedhead side of the bedstead housing 30 and the delivery roller 20 and the rolled sheet 10 mounted inside the bedstead housing 30 are adjacent to the delivery slit 31.

Figure 3:
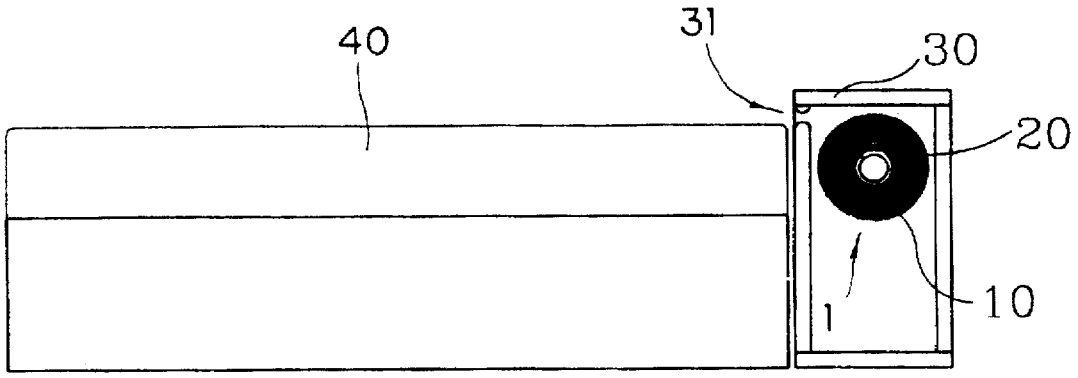
FIG. 3 is another perspective elevation view the above first embodiment of the present invention, illustrating the disposition of the continuous bedclothes device within a bedside housing.
Figure 4:
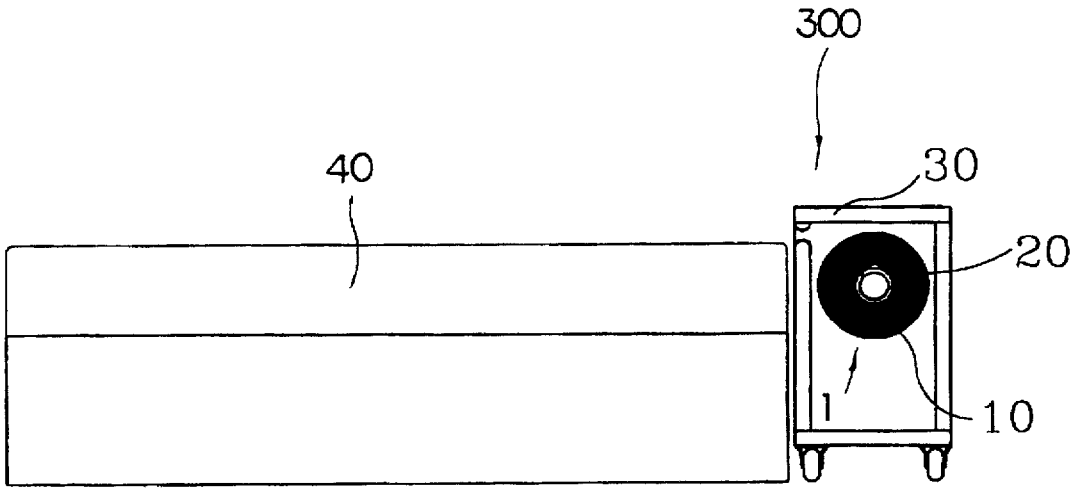
FIG. 4 is another perspective elevation view the above first embodiment of the present invention, illustrating the disposition of the continuous bedclothes device within a movable bedside housing.

As shown in FIG. 3, the housing 30 is designed as a bedside cupboard housing with the delivery slit 31 positioned in the upper front side. The bedside cupboard housing 30 is placed at the bedside. Referring to FIG. 4, an alternative mode of the bedside cupboard housing 30 is illustrated, in which the bedside cupboard housing 30 further comprises a plurality of bottom roller 300 for easy movement.

Accordingly, the user can deliver a bedclothes unit from the continuous bedclothes device 1 via its delivery slit 31 for setting the mattress as bedsheet or acting as a bedspread.

Furthermore, the dividing lines 11 can be designed as transversely crack lines that each bedclothes unit is attached to one another with a tension enough to connect the plurality of bedclothes units to form the elongated sheet 10. When a manual tearing force is applied to the cracked dividing line 11 between two bedclothes units, an outermost bedclothes unit is able to tear off from the sheet 10 for bedsheet or bedspread usage.

For the present invention, there are a number of alternative and modified embodiments in the best mode for use with adaptability to various features of structural design. Such embodiments are described as follows.

Figure 5:
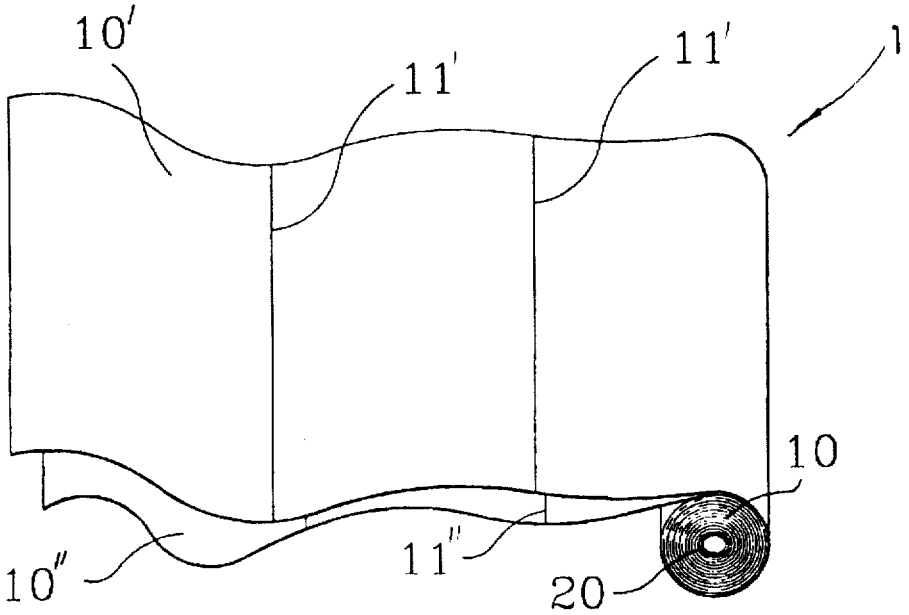
FIG. 5 is a perspective view of a continuous bedclothes device of a continuous bedclothes apparatus according to a preferred second embodiment of the present invention.

Referring to FIG. 5, a preferred second embodiment is illustrated. When the long sheet 10 is large enough to cover an entire bed and the delivery device is large enough to accommodate the roll of long sheet 10 rolled on the roller 20 of the continuous bedclothes device 1, double layers 10' and 10" of long sheet 10 can be rolled onto the delivery roller 20. For every appropriate length of the long sheet 10, both layers 10' and 10" of the long sheet 10 has a plurality of dividing lines 11 for dividing both the upper layer 10' and the lower layer 10" of long sheet 10 to form a plurality of symmetrical upper and lower bedclothes units. Since the long sheet 10 according to the present second embodiment has double layers 10' and 10", when the long sheet 10 is unrolled from the delivery roller 20 to cover the bed, the upper layer of each bedclothes unit 10' becomes a bedspread and the lower layer of the bedclothes unit 10" becomes a bedsheet with its edges folded underneath the mattress of the bed.

The delivery device 300, as shown in FIGS. 2 to 4, can has a width shorter than the bedside wherein modified modes of the long sheet 10 are applied for accommodation.

Figure 6:
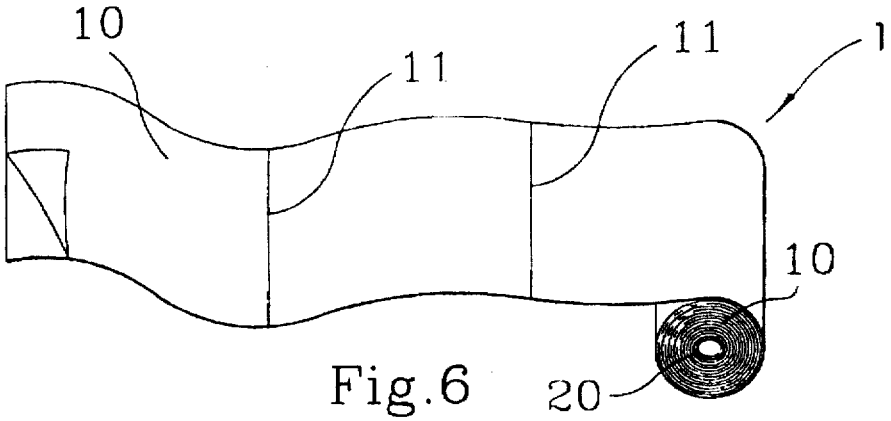
FIG. 6 is a perspective view of a continuous bedclothes device of a continuous bedclothes apparatus according to a preferred third embodiment of the present invention.

Referring to FIG. 6, a continuous bedclothes apparatus according to a third embodiment of the present invention is illustrated, in which each bedclothes unit of the long sheet 10 is shorter than the length or width of the bed, the long sheet 10 is folded along its median into half of its size and rolled on the delivery roller 20 as a folded double-layered long sheet 10. To cover the bed, the long sheet 10 is pulled out from the delivery roller 20 mounted within the delivery device 300 (as shown in FIGS. 2–4 and not shown in FIG. 6) and unfolded to regain its full size.

Figure 7:
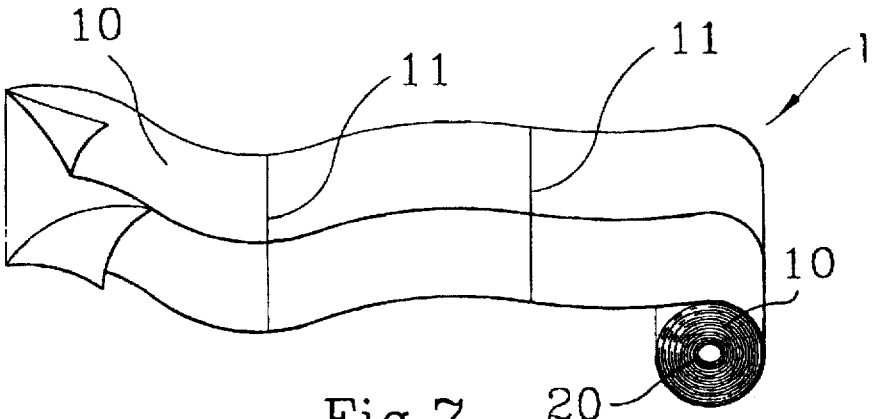
FIG. 7 is a perspective view of a continuous bedclothes device of a continuous bedclothes apparatus according to a preferred fourth embodiment of the present invention.

Referring to FIG. 7, a continuous bedclothes apparatus according to an alternative fourth embodiment of the present invention is illustrated. Alternatively, when each bedclothes unit of the long sheet 10 is shorter than the length or width of the bed, the long sheet 10 can be folded twice with its two sides meeting at its median before installed in the delivery roller 20. To cover the mattress, a bedclothes unit of the long sheet 10 is pulled out from the delivery roller 20 and unfolded on both sides to regain its full size.

In addition, when the size of each of the bedclothes units of the long sheet 10 is large enough to accommodate the roll of long sheet 10 rolled on the delivery roller 20 and the width of the long sheet 10 is sufficient to cover an entire bed, a single layer of long sheet 10 can be rolled onto the delivery roller 20. The aforesaid first, second, third, and fourth embodiments as shown in FIGS. 1, 5, 6, and 7 are various alternative modes of the elongated long sheet 10 rolled on the delivery roller 20 which can all be installed in the delivery device 300 as shown in FIGS. 2,3 or 4.

Figure 8:
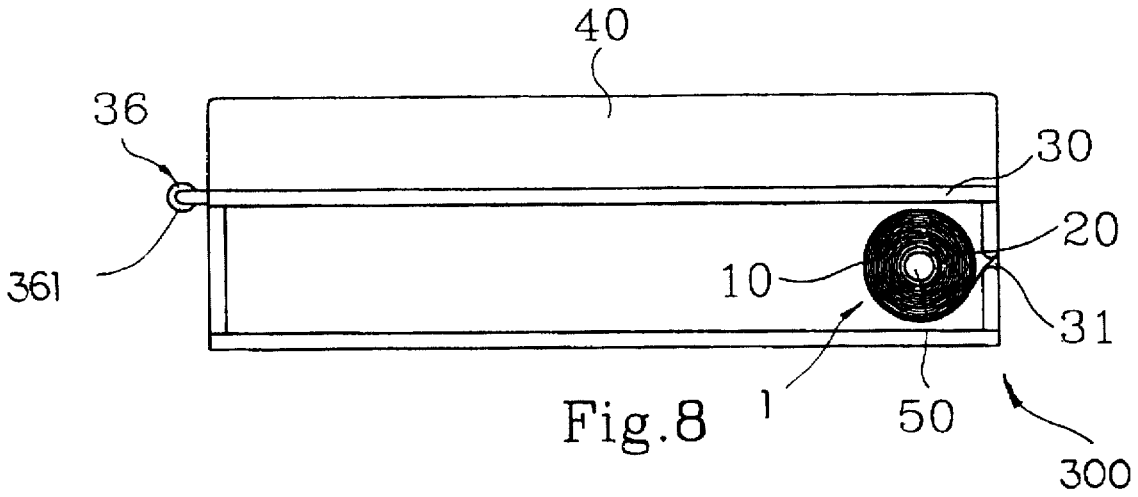
FIG. 8 is a perspective elevation view of a continuous bedclothes apparatus according to a preferred fifth embodiments of the present invention, illustrating the disposition of the continuous bedclothes device within a bedstead housing having a reversing stand.
Figure 9:
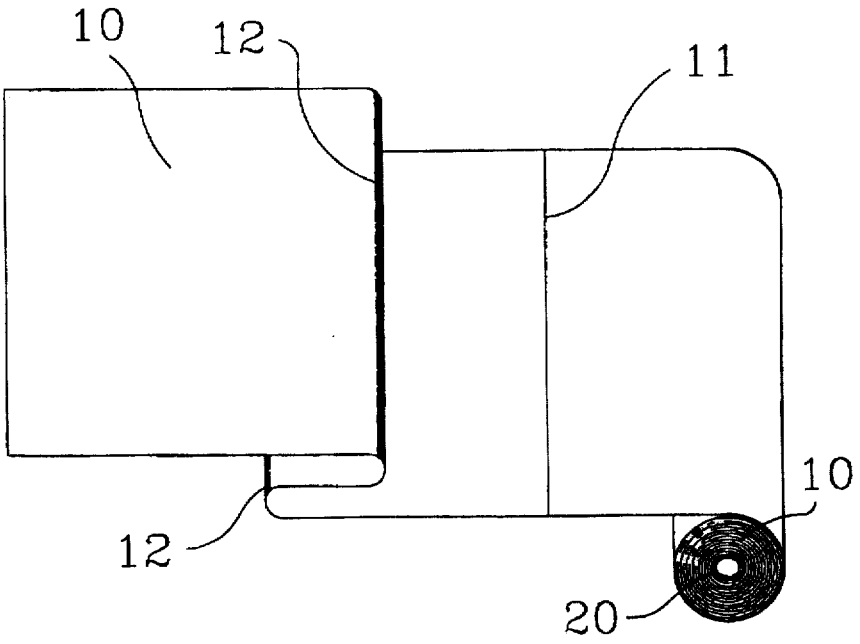
FIG. 9 is a perspective view of a continuous bedclothes device of a continuous bedclothes apparatus according to a preferred sixth embodiment of the present invention.
Figure 21:
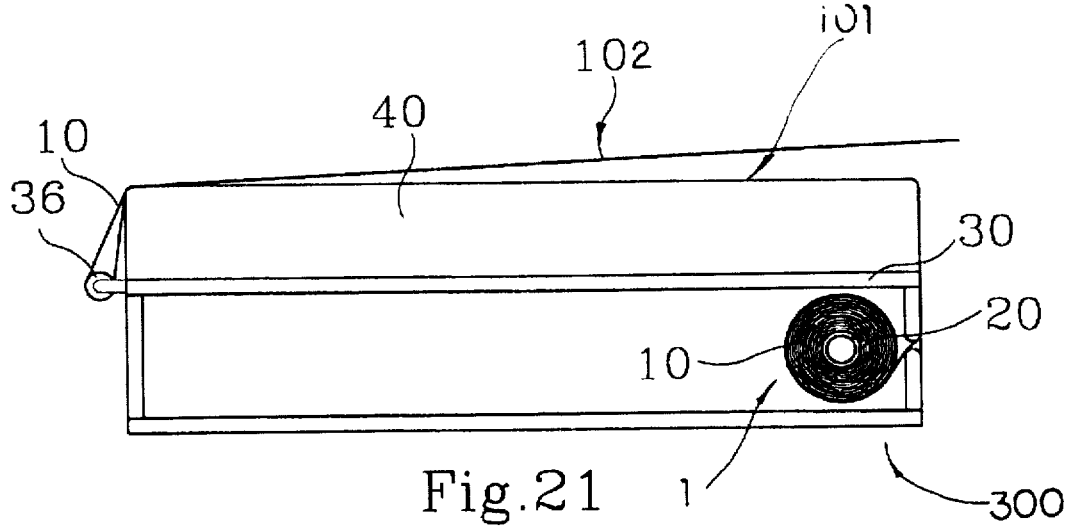
FIG. 21 is a perspective elevation view the above preferred fifth embodiment of the present invention.

Referring to FIG. 8, a continuous bedclothes apparatus according to a preferred fifth embodiment of the present invention is illustrated. The housing 30 of the delivery device 300, in which the long sheet 10 and the delivery roller 20 are installed at one end, further comprises a reversing stand 36 having a long reversing roller 361 mounted thereon. Such device is specifically accommodated to a single layer of long sheet 10 which has a plurality of bedclothes units having a length double the length of the mattress 40 and the bedclothes units are also divided by the dividing lines 11 intervally. At the middle position between the two dividing lines 11 of every bedclothes unit has a folding line 12, as shown in FIG. 9 which illustrates a sixth embodiment oft he present invention. Therefore, each bedclothes unit of the long sheet 10 can be pulled out from the delivery roller 20 within the delivery device 300 to cover the top surface of the mattress 40 to form a lower layer acting as a bedsheet 101 and then turn over at the folding line 12 by the reversing roller 361 of the reversing stand 36 to form a upper layer acting as a bedspread 102, as shown in FIG. 21. To change the bedclothes, it is only required to pull out a new bedclothes unit of the sheet 10 and make it cover the mattress 40 and the used bedclothes unit of the sheet 10 can simply be torn off along the next dividing line 11.

Figure 10:
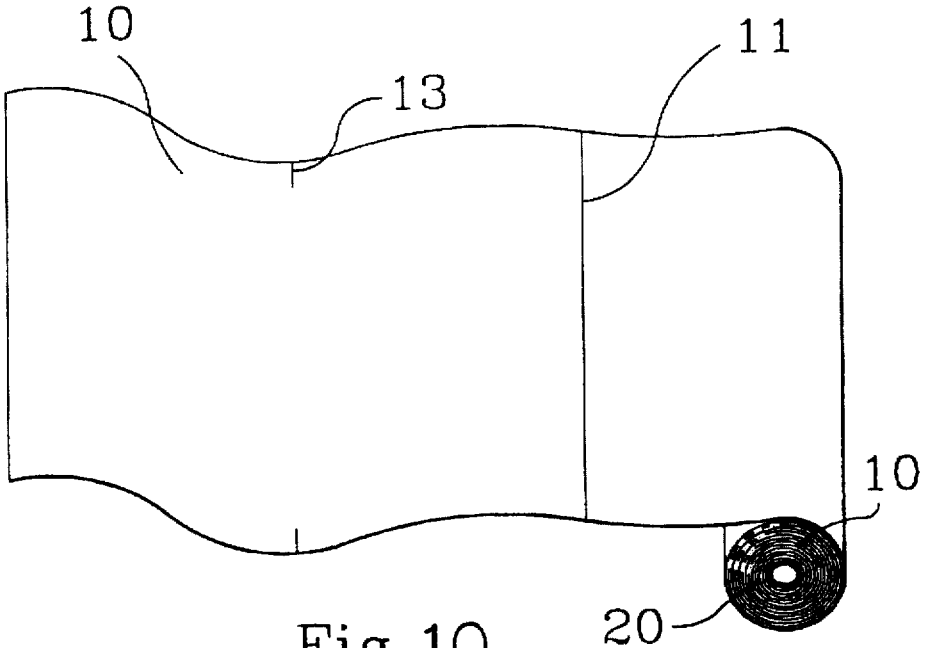
FIG. 10 is a perspective view of a continuous bedclothes device of a continuous bedclothes apparatus according to a preferred seventh embodiment of the present invention.

Referring to FIG. 10, a continuous bedclothes apparatus according to a seventh embodiment of the present invention is illustrated. Each bedclothes unit of the long sheet 10 has a pair of tear lines 13 located on the opposite sides of the unit at mid length. The length of the tear lines 13 is slightly larger than the thickness of the mattress or just a pair of fold points so that the bedsheet unit can be turned back by the reversing stand 36 and separated at the tear lines 13 to render the bottom layer being placed smoothly underneath the mattress 40.

Figure 11:
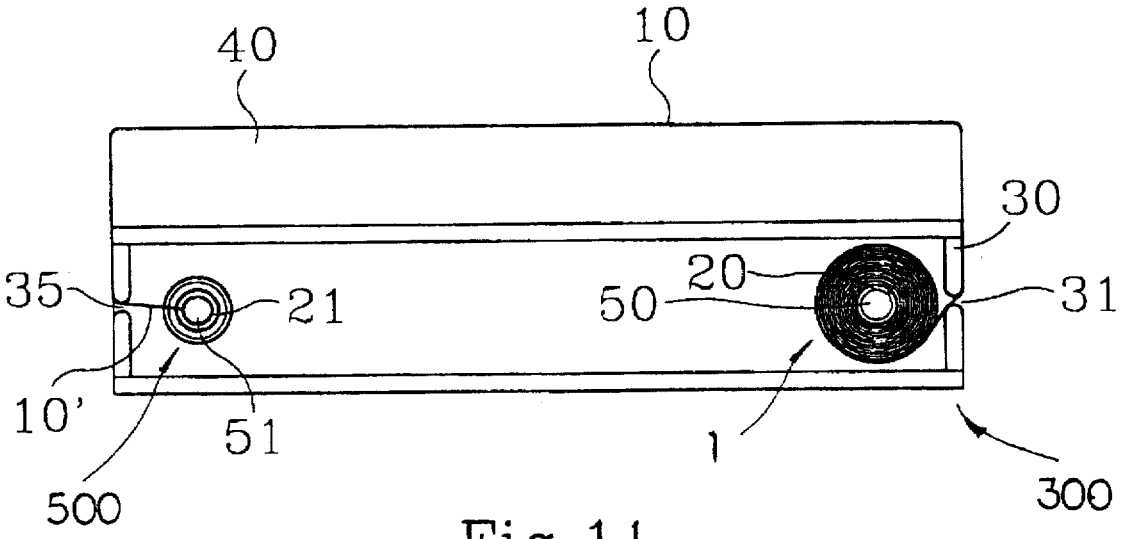
FIG. 11 is a perspective elevation view of a continuous bedclothes apparatus of a preferred eighth embodiment of the present invention, illustrating the disposition of the continuous bedclothes device within a bedstead housing having a receiving roller.

When the long sheet 10 is made of tissue paper or recyclable paper cloth, the used bedclothes can be recycled to meet the demand for environmental protection. The continuous bedclothes apparatus of the present invention can further comprises a receiving device 500 which includes a receiving roller 21 mounted to another opposite side of the housing 30 of the delivery device 300. FIG. 11 illustrating a preferred eighth embodiment, the receiving device 500 is installed within the space inside the bedstead housing 30 that the receiving roller 21 is installed correspondingly with the delivery roller 20 at the other end of the bedstead housing 30 which has a receiving slit 35 for the incoming of the used long sheet 10 to roll onto the receiving roller 21.

Figure 12:
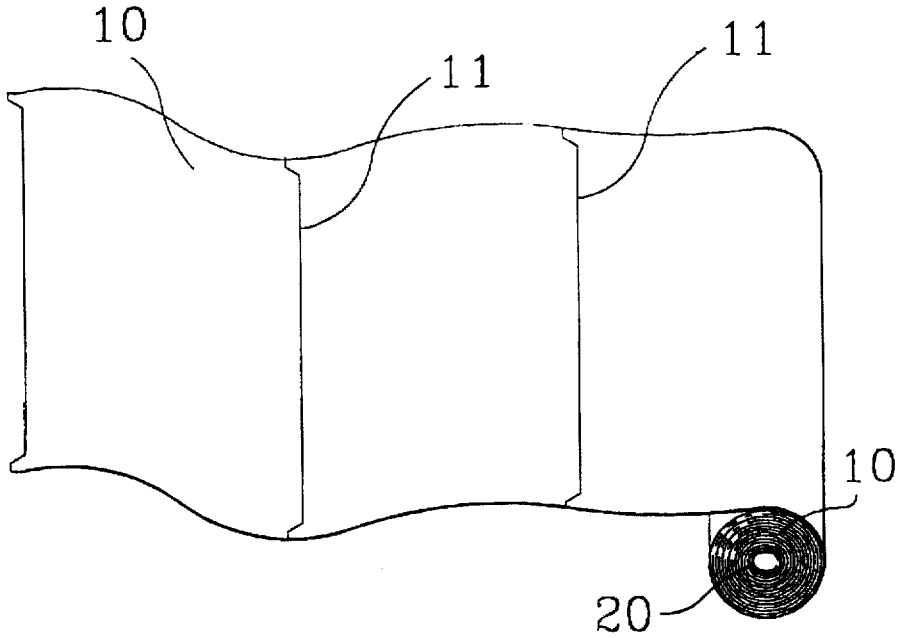
FIG. 12 is a perspective view of a continuous bedclothes device of a continuous bedclothes apparatus according to a preferred ninth embodiment of the present invention.
Figure 13:
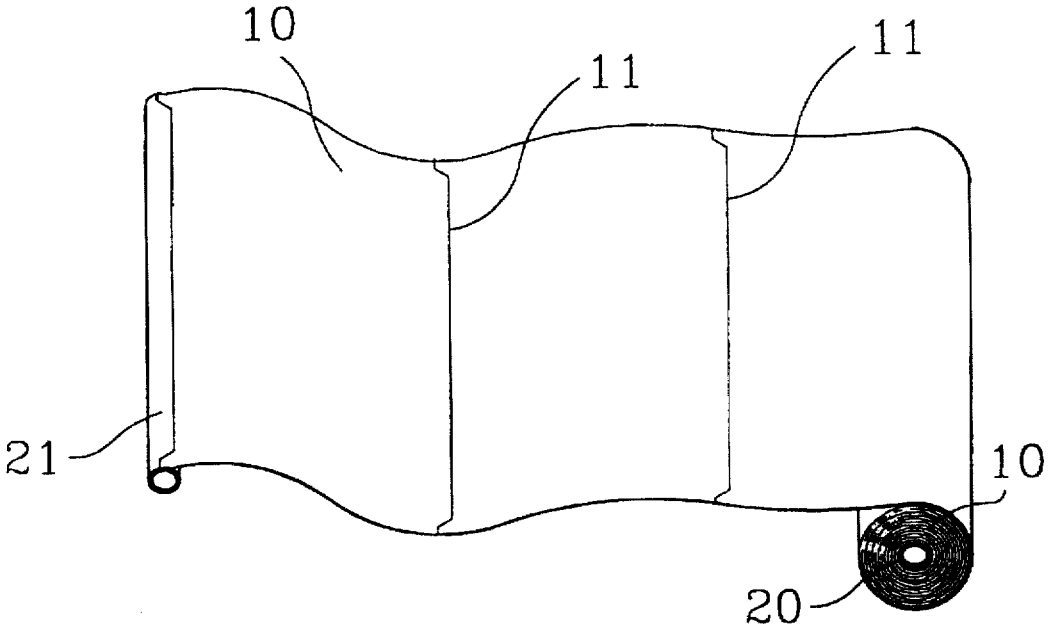
FIG. 13 is a perspective view of a continuous bedclothes device of a continuous bedclothes apparatus according to the above ninth embodiment of the present invention, showing how the long sheet adhere to a receiving roller.

When the receiving device 500 is utilized in the continuous bedclothes apparatus for receiving used long sheet 10, various types of long sheet 10 as described hereinafter can be applied. Referring to FIG. 12, a continuous bedclothes apparatus according to a ninth embodiment of the present invention is illustrated, in which the long sheet 10 is also divided into a plurality of bedclothes units by a plurality of specific dividing lines 11. The two ends of each dividing lines are extended inclinedly forward to form a jutting corner respectively so that the front corners of the rear bedclothes unit is trimmed for fitting the jutting corners of the rear corners of the front bedclothes unit. Such jutting corners are used to adhere the corresponding bedclothes unit to the receiving roller 21 for easy rolling thereon, as shown in FIG. 13, when the bedclothes unit has been separated from the long sheet 10, used and is ready for being recycled.

Figure 14:
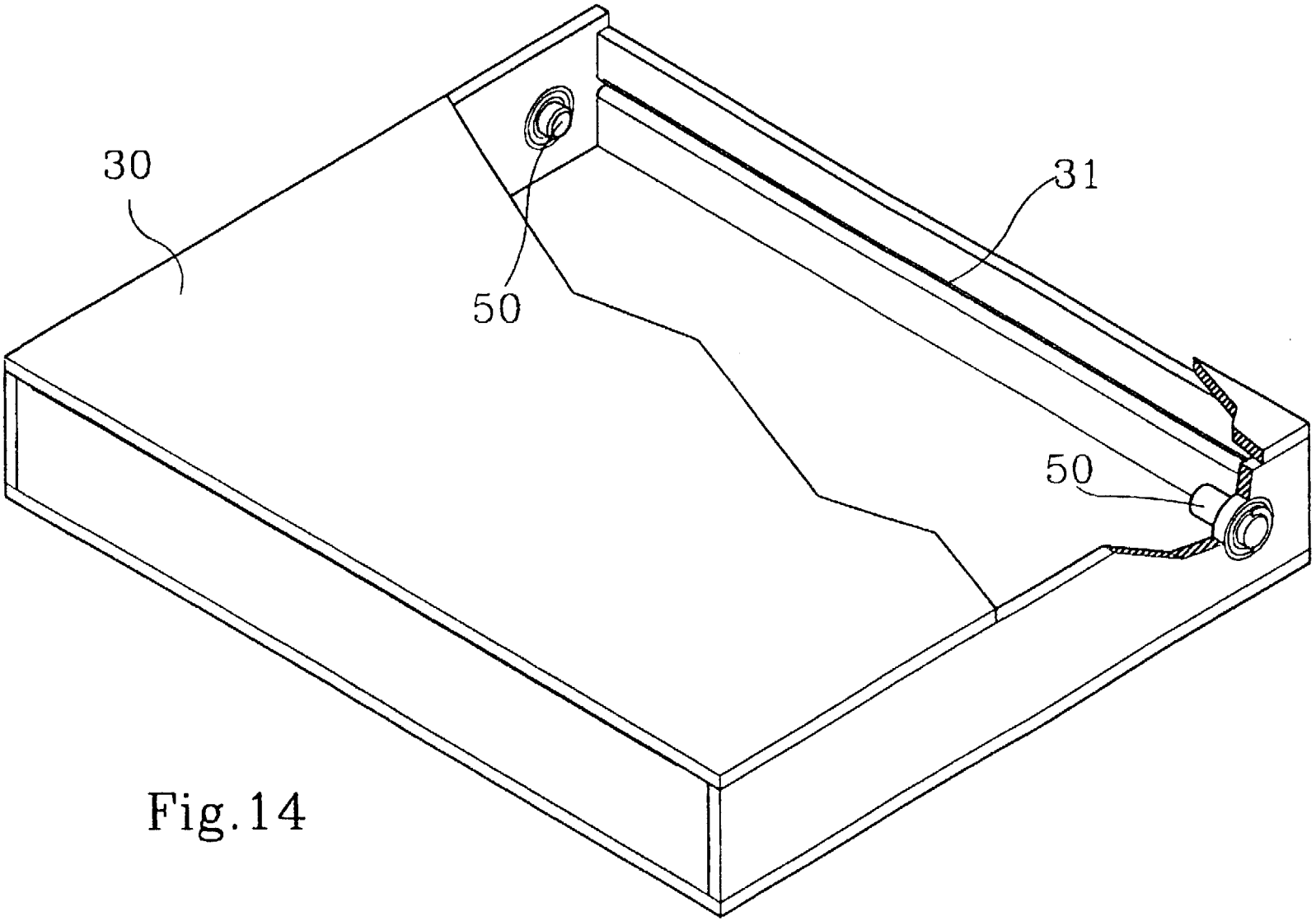
FIG. 14 is a partial sectional perspective view illustrating a delivery device of a continuous bedclothes apparatus installed along the long side of a bedstead housing according to the above preferred first embodiment of the present invention.

Referring to FIG. 14, it is a partial sectional perspective view of the above first embodiment shown in FIG. 2. The bedstead housing 30 is used to support the mattress 40 wherein the delivery device 300 for the continuous long sheet 10 is installed therein. The pair of supporting axles 50 of the delivery device 300 is installed in the bedstead housing 30 for supporting the delivery roller 20 in rotary manner in which the axial line between the two supporting axles 50 is parallel to the delivery slit 31.

The two supporting axles 50 are installed on the two opposite short sides of the bedstead housing 30. The delivery roller 20 is mounted between the two supporting axles 50 in rotary manner so that the continuous long sheet 10 rolled on the delivery roller 20 is supported by the axles 50 and is able to delivery through the delivery slit 31 provided on the long side of the bedstead housing 30.

Figure 15:
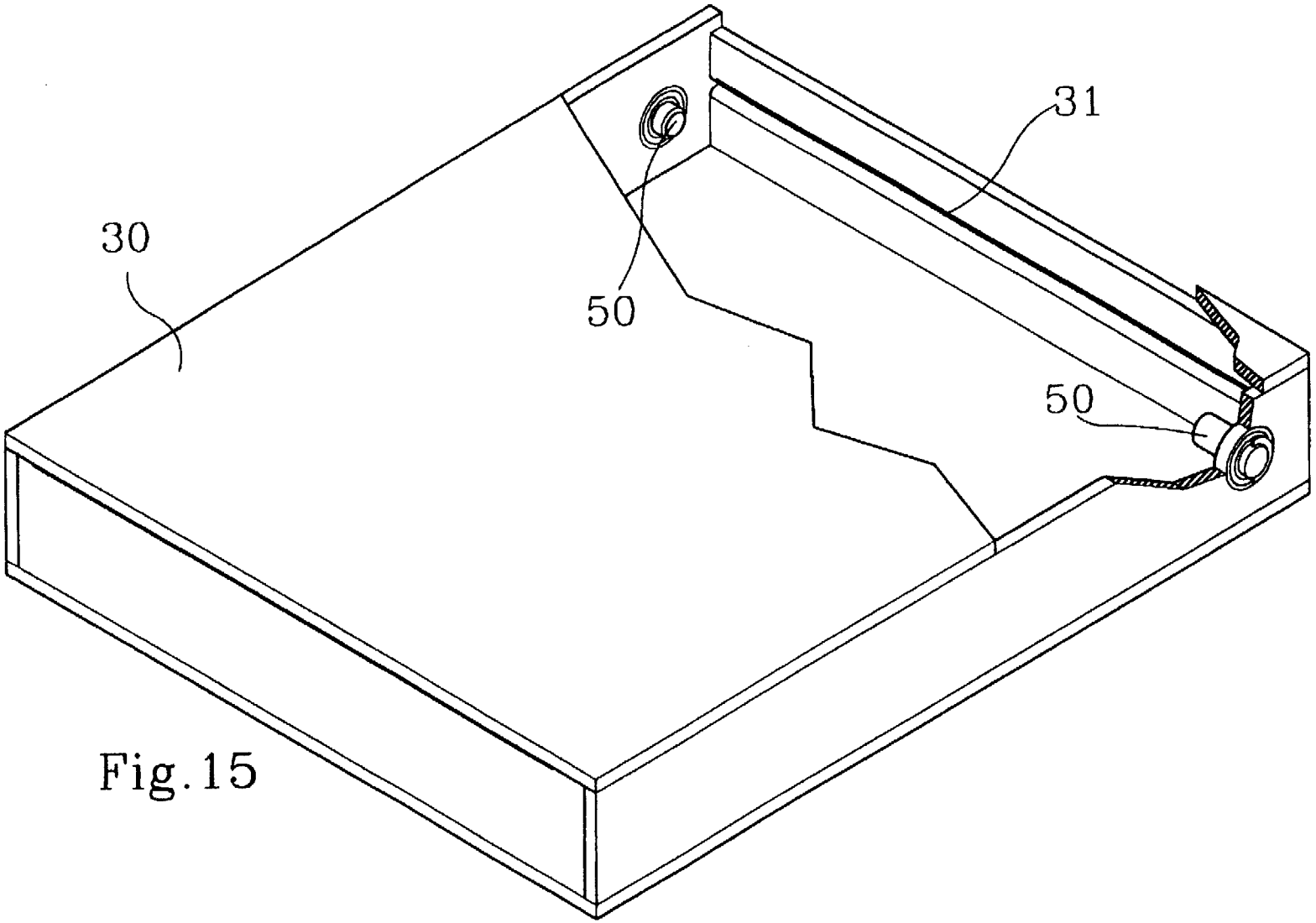
FIG. 15 is a perspective view of a delivery device of a continuous bedclothes apparatus installed along the short side of a bedstead housing according to a preferred tenth embodiment of the present invention.

Referring to FIG. 15, an alternative mode of the delivery device of the continuous bedclothes apparatus according to a preferred tenth embodiment of the present invention is illustrated. The two supporting axles 50 are installed on the two opposite long sides of the bedstead housing 30 and the delivery slit 31 is provided on the short side of the bedstead housing 30. Accordingly, the continuous long sheet 10 rolled on the delivery roller 20 which is mounted between the two supporting axles 50 and parallel to delivery slit 31 can be fed through the delivery slit 31.

When the long sheet 10 has two layers rolled onto the delivery roller 20 as disclosed in FIG. 5 of the second embodiment, the free end of the long sheet 10 is pulled outside from the delivery slit 31 and unrolled from the delivery roller 20 to cover the bed, the top layer 10' of the long sheet 10 becomes a bedspread and the bottom layer 10" is folded underneath the mattress 40 to make a bedsheet (as shown in FIG. 5). When the user would like to replace a new set of bedspread and bedsheet with the used one, a new unit of the long sheet 10 can be pulled out onto the mattress 40 on the top of the old ones and severed along the dividing line 11.

Figure 16:
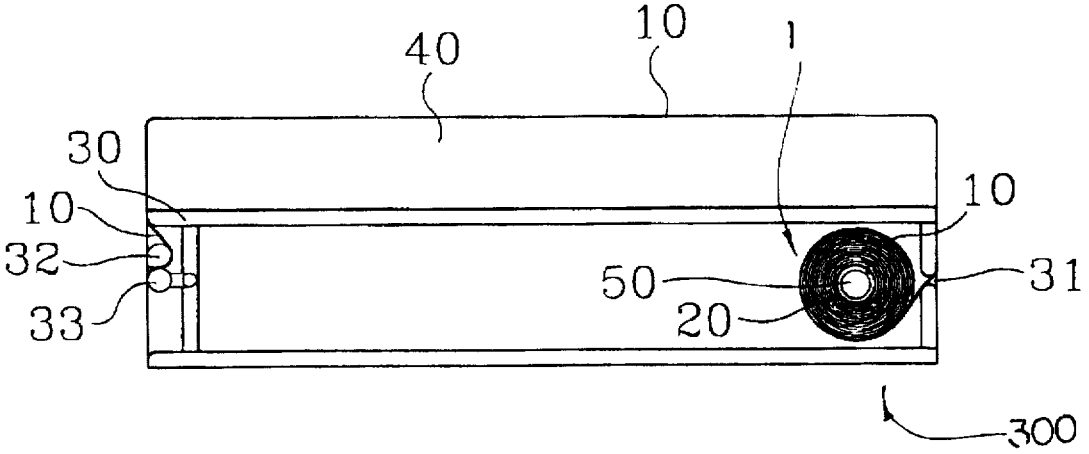
FIG. 16 is a perspective elevation view a preferred eleventh embodiment of the present invention, illustrating the disposition of the continuous bedclothes device in a bedstead housing which has a pressing rod.

Referring to FIG. 16, a continuous bedclothes apparatus according to a preferred eleventh embodiment of the present invention is illustrated, which is an alternative mode of the above first embodiment as shown in FIG. 2, wherein the delivery device further comprises a fixing rod 32 and a pressing rod 33 affixed to the other side opposite to the first side having the delivery slit 31 of the bedstead housing 30 for facilitating the task of separate the used bedclothes unit of the sheet 10. The fixing rod 32 has a vertical outer side at its lower half. Below the fixing rod 32, the pressing rod 33 is installed in parallel to the fixing rod 32 in such manner that it is able to lift up to press on the bottom of the fixing rod 32 or to push down away from the fixing rod 32. When a clean new bedclothes unit of the sheet 10 is pulled out from the delivery roller 20 via the delivery slit 31 to cover the mattress 40, the free end of the sheet 10 is extended along the inner side the fixing rod 32 and pulled outward through the space between fixing rod 32 and pressing rod 33. The pressing rod 33 is then lifted upward to press on the bottom of the fixing rod 32 and the free end portion of the sheet 10 so as to keep the free end portion of the bedclothes unit of the sheet 10 engaged between the fixing rod 32 and the pressing rod 33. While the user would like to replace an used bedclothes unit with another new bedclothes unit of the sheet 10, the pressing rod 33 is pushed downward to release the pressing force of the free end of the used bedclothes unit and the sheet 10 is pulled out until the next dividing line 11 of the sheet 10 reaches fixing rod 32, so that the new bedclothes unit of the sheet 10 is delivered to cover the mattress 40. Then, the pressing rod 33 is lifted upward again to press on the fixing rod 32 and the free end portion of the new bedclothes unit of the sheet 10 so as to keep the new bedclothes unit in position. Finally, the used bedclothes unit of the sheet 10 can easily be torn off along the vertical outer side of the fixing rod 32.

Figure 17:
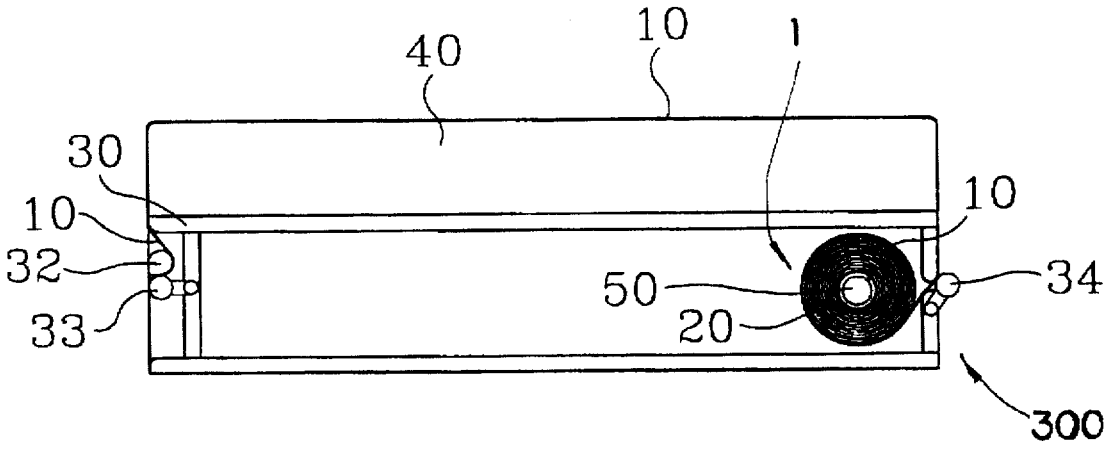
FIG. 17 is a perspective elevation view a preferred twelfth embodiment of the present invention, illustrating the disposition of the continuous bedclothes device in a bedstead housing which has a pressing rod and a delivery pressing rod.

FIG. 17 illustrating a preferred twelfth embodiment, which is an alternative mode of the eleventh embodiment, of the present invention is illustrated. The delivery device 300 further comprises a delivery pressing rod 34 mounted along the delivery slit 31 of the bedstead housing 30 in such manner that the delivery pressing rod 34 can be turned to various positions for catching and releasing the sheet 10 to prevent the continuous sheet 10 from further delivering after the mattress 40 is set.

Figure 18:
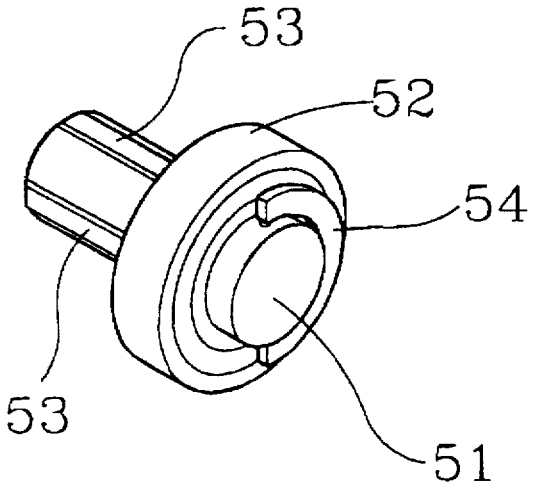
FIG. 18 is a perspective view of a supporting axle of the receiving roller of the present invention.
Figure 19:
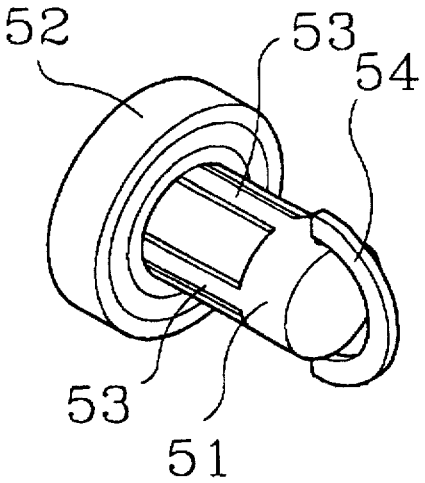
FIG. 19 is an operational perspective view of the supporting axle in FIG. 18 of the present invention.

Referring again to FIG. 11, the receiving roller 21 of the receiving device 500 is held by a second pair of supporting axles 51 (as shown in FIGS. 18 and 19) which are identical with the supporting axles 50 in configuration and installed to the other two parallel sides of the bedstead housing 30. The receiving roller 21 are mounted between the second pair of supporting axles 51 in such manner that it is able to rotate manually or by electricity. There are a number of mechanisms that can be used with the receiving roller 21 and described by the following working examples.

Referring to FIGS. 18 and 19, each of the supporting axles 51 is installed on a holding bearing 52 and has a plurality of longitudinal tenons 53 on its shaft. A rotation handle 54 is installed on the external end of each supporting axle 51. The rotation handle 54 can be pulled out to different extents to adjust the length of the supporting axle 51 for mounting the receiving roller 21. The tenons 53 are fit into corresponding indentions provided on the receiving roller 21. Therefore, used bedclothes units of sheet 10 are rolled onto the receiving roller 21 by turning the rotation handle 54 manually.

Figure 20:
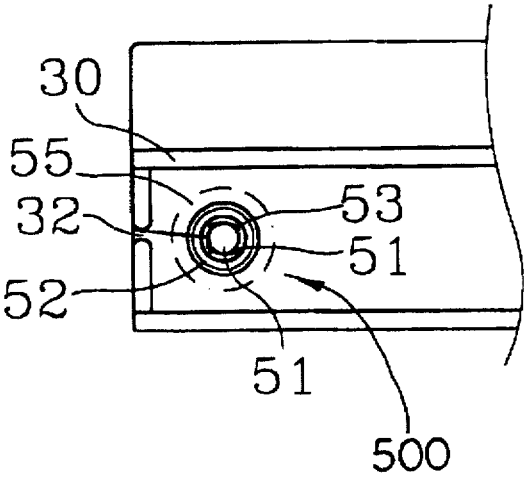
FIG. 20 is a perspective elevation view of the supporting axle installed in a bedstead housing with a driving motor of the present invention.

Referring to FIG. 20, the two supporting axles 51 are installed on the two holding beatings 52 respectively and have the plurality of tenons 53. A motor 55 is connected to one of the supporting axles 51 which becomes an extended shaft of the motor 55. Since the tenons 53 are fit into corresponding indentions provided on the receiving roller 21 as mentioned above, used bedclothes units of the sheet 10 are rolled onto the receiving roller 21 by the driving rotation of the motor 55.

There are a plurality of alternative modes of the delivery device 300 according to various kinds of configuration of the continuous sheet 10 as disclosed above.

Figure 22:
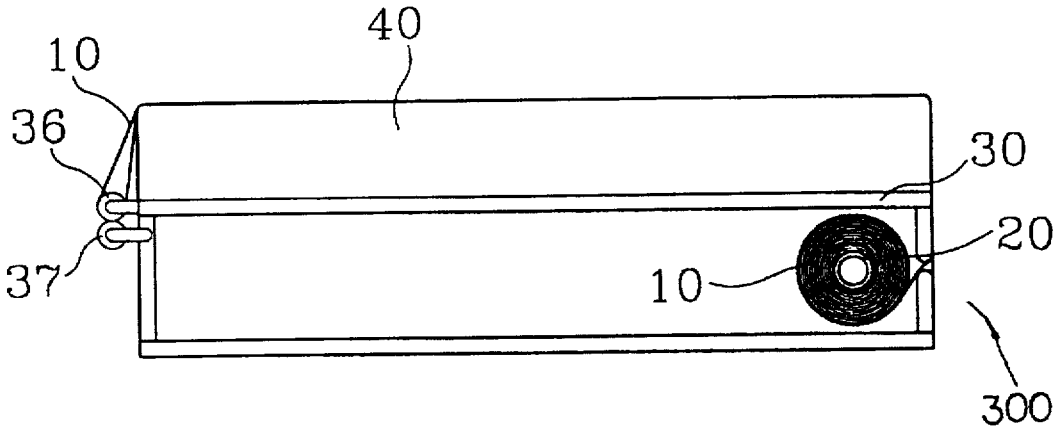
FIG. 22 is a perspective elevation view a preferred thirteenth embodiment of the present invention, illustrating the disposition of the continuous bedclothes device in a bedstead housing which has a receiving stand and a delivery pressing stand.

Referring to FIGS. 8 and 21 of the above fifth embodiment of the present invention, the single layer of continuous sheet 10 rolled on the delivery roller 20 as illustrated in FIG. 1 is installed in the bedstead housing 30 of the delivery device 300 which has the reversing stand 36 (as shown in FIG. 8). The sheet reversing stand 36 can be a round rod and the mattress 40 can be set with bedclothes as described above. A preferred thirteenth embodiment is illustrated in FIG. 22 which is an alternative mode of the above fifth embodiment. The delivery device 300 further comprises a delivery pressing stand 37 installed beneath the reversing stand 36 in such manner that the delivery pressing stand 37 is able to lift upward to press on the bottom of the reversing stand 36 or to push downward away from the delivery pressing stand 37. When the delivery pressing stand 37 is set at its upward position to press on the folding line 12 of the sheet 10 (as shown in FIG. 9), the sheet 10 is kept firmly between the reversing stand 36 and the delivery pressing rod 37 and cannot be pulled out further.

Figure 23:
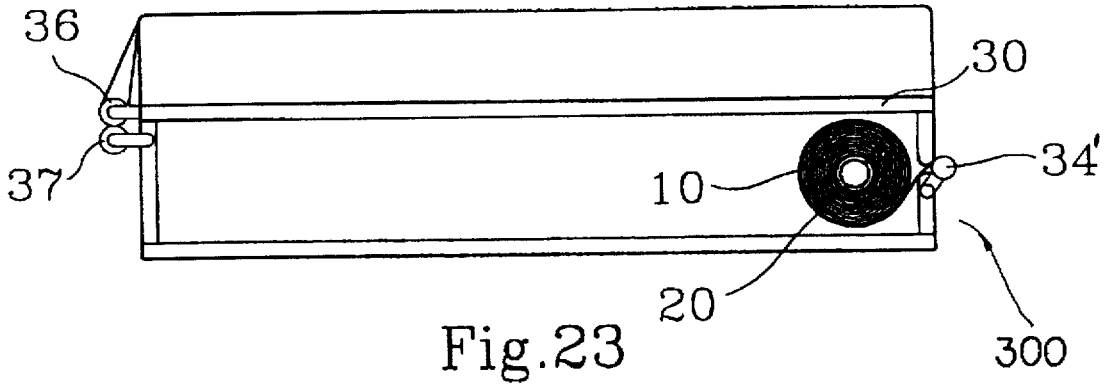
FIG. 23 is a perspective elevation view a preferred fourteenth embodiment of the present invention, illustrating the disposition of the continuous bedclothes device in a bedstead housing which has a receiving stand, a delivery pressing stand and a delivery pressing rod.

Referring to FIG. 23, a continuous bedclothes apparatus according to a fourteenth embodiment of the present invention is illustrated, which is a further modification of the above thirteenth embodiment. The delivery device 300 further comprises a delivery pressing rod 34' installed along the delivery slit 31. The delivery pressing rod 34' can be turned to a certain degree of angle for catching and releasing the sheet 10 to prevent the continuous sheet 10 from further delivering after the bed is set.

Figure 24:
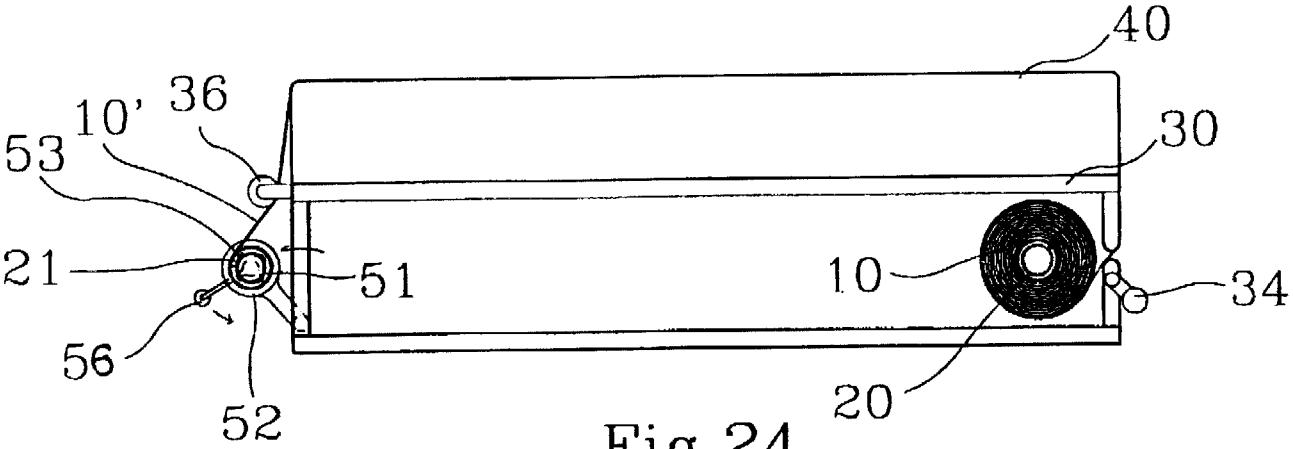
FIG. 24 is a perspective elevation view a preferred fifteenth embodiment of the present invention, illustrating the disposition of the continuous bedclothes device in a bedstead housing which further has a rotation handle.

Referring to FIG. 24, a continuous bedclothes apparatus according to a fifteenth embodiment of the present invention is illustrated, which is a modification of the above twelfth embodiment as shown in FIG. 17. The continuous bedclothes apparatus further comprises a receiving device 500 which includes a pair of supporting axles 51 for supporting the receiving roller 21 for receiving the used sheet 10. The pair of supporting axles 51 are installed in the bedstead housing 30 by means of a pair of axial holders 52 respectively. Each supporting axle 51 has a plurality of longitudinal tenons 53 on its shaft. A rotation handle 56 is installed on the external part of one of the supporting axles 51. The rotation handle 56 can be pulled out from the far end of the bedstead housing 30 to different extents to adjust the length of the supporting axles 51 for installing the receiving roller 21. The tenons 53 are fit into corresponding longitudinal indentions provided on the receiving roller 21. Used bedclothes units of the sheet 10 are rolled onto the receiving roller 21 by turning the rotation handle 56 manually. The used sheet 10 is rotated to the dividing lines 11 and separated. The clean new bedclothes unit of sheet 10 is pulled out to cover the mattress 40 of the bed.

Figure 25:
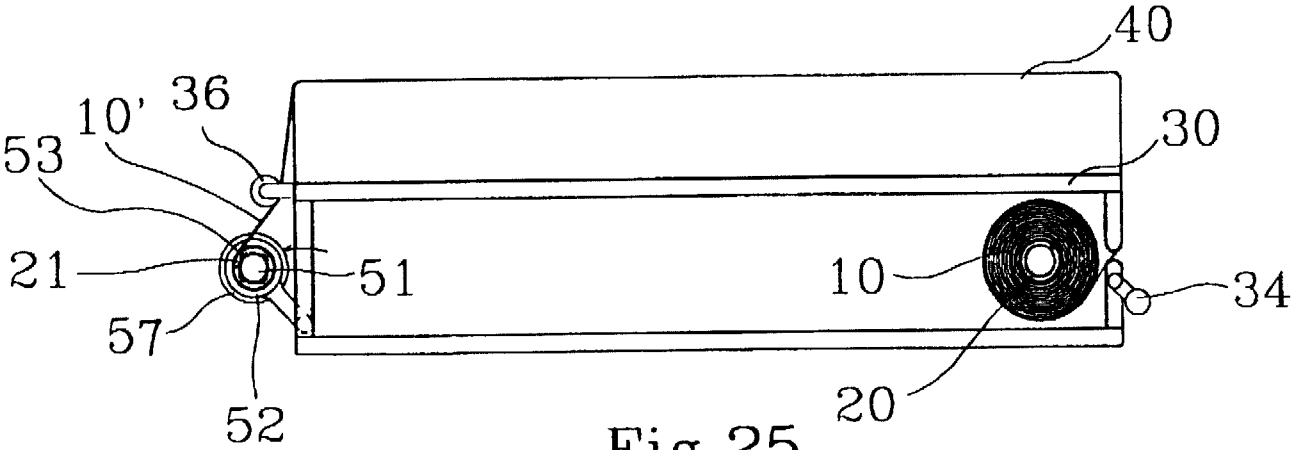
FIG. 25 is a perspective elevation view a preferred sixteenth embodiment of the present invention, illustrating the disposition of the continuous bedclothes device in a bedstead housing which further has a driving motor.

Referring to FIG. 25, a continuous bedclothes apparatus according to a preferred sixteenth embodiment of the present invention is illustrated, which is an alternative mode of the above fifteenth embodiment, wherein the rotation handle 56 is substituted by a driving motor 57 which is connected to one of the supporting axles 51 becoming an extended shaft of the driving motor 57. Therefore, used bedclothes units of the sheet 10 are able to roll automatically onto the receiving roller 21 by the rotation of the motor 57.

There are also various alternative working modes for the delivery device 300, wherein a bedside housing is applied instead of the bedstead housing. The following embodiments are based on installing the continuous bedclothes apparatus to a bed or bedframe having both the bedstead and bedside cupboard wherein the mattress is placed on the bedstead.

Figure 26:
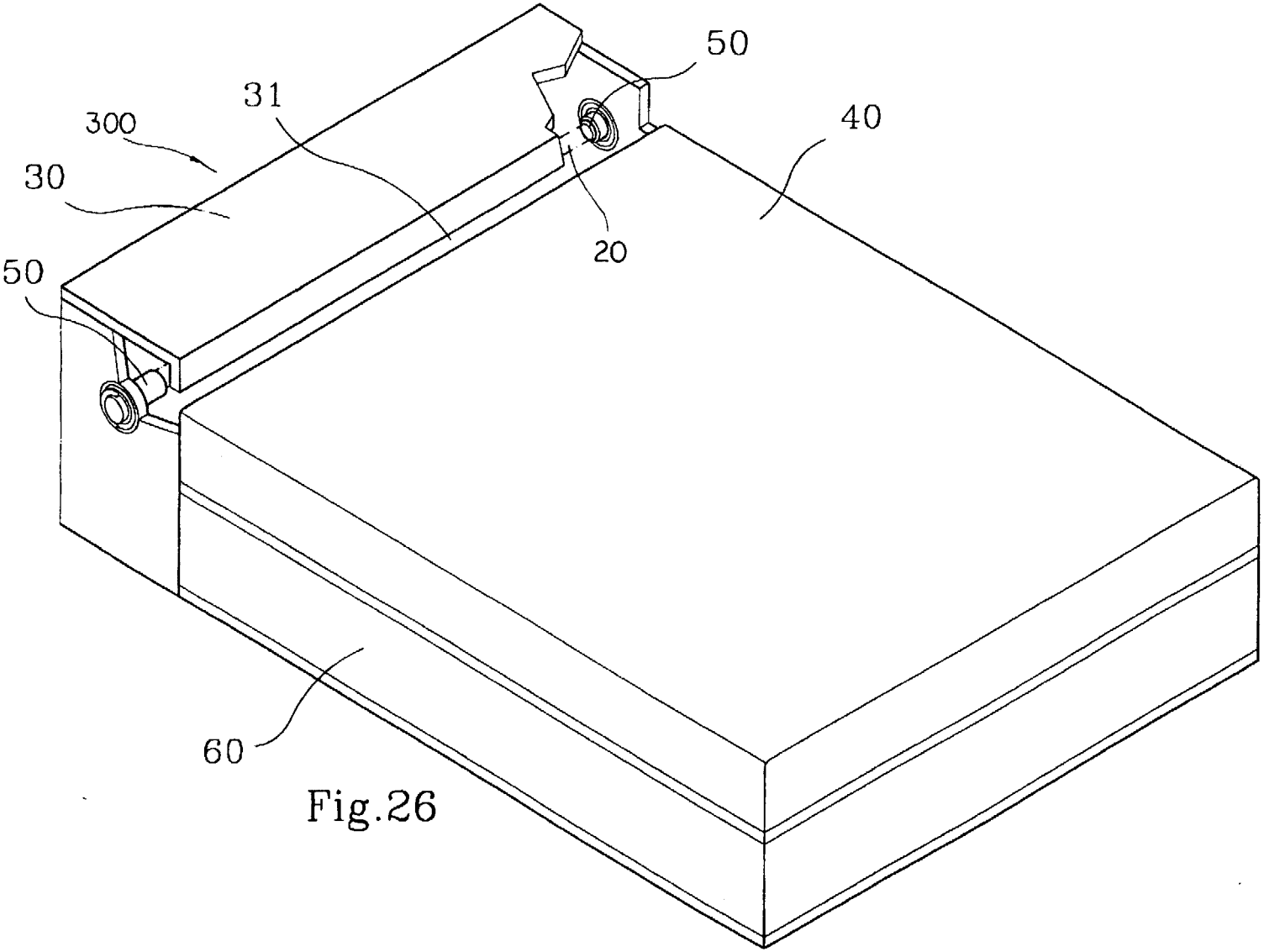
FIG. 26 is a perspective view of a delivery device of a continuous bedclothes apparatus installed in a bedside housing according to a preferred seventeenth embodiment of the present invention.

Referring to FIG. 26, a continuous bedclothes apparatus according to a preferred seventeenth embodiment of the present invention is illustrated, in which the housing 30 of the delivery device 300 is a bedside housing which can be acting as a bedside cupboard and the mattress 40 is placed on a bedstead 60 adjacent to the bedside cupboard. The upper portion of the front side of the bedside housing 30 also has a transverse delivery slit 31 and the delivery roller 20 is mounted inside the bedside housing 30, parallel to the delivery slit 31, by means of a pair of supporting axles 50 which are installed on the two sides of the bedside housing 30.

Accordingly, various kinds of the continuous sheet 10 of the continuous bedclothes device 1, as shown in FIGS. 1, 5, 6, 7, 9, 10, and 12, are able to utilize in the aforesaid seventeenth embodiment. The continuous sheet 10 is rolled on the delivery roller 20 is able to pull outside via the delivery slit 31 and is unrolled from the delivery roller 20 to cover the mattress 40 of the bed. The top layer of the long sheet 10, if present, becomes a bedspread and the bottom layer of the long sheet 10 covering the mattress 40 with its edges folding underneath the mattress 40 becomes a bedsheet. New bedclothes units of the long sheet 10 can be pulled out onto the mattress 40 on the top of the old used one and severed along the dividing lines 11 thereon.

Figure 27:
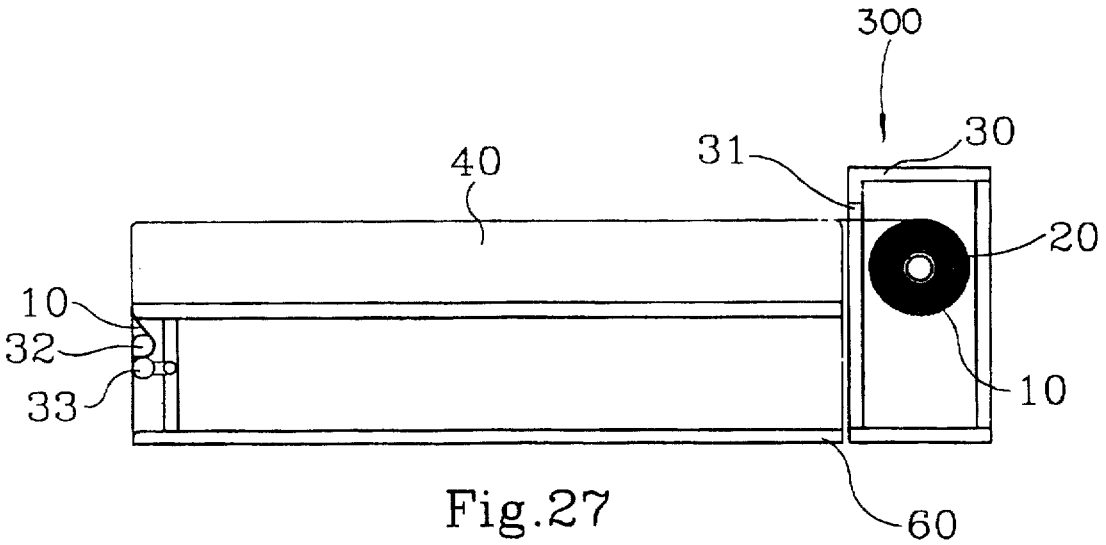
FIG. 27 is a perspective elevation view according to the above seventeenth embodiment of the present invention.

Referring to FIG. 27, it is a modification of the aforesaid seventeenth embodiment of the present invention. The delivery device 300 further comprises a fixing rod 32 and a pressing rod 33 affixed to the far end of the bedstead 60 for facilitating the task of separate the used bedclothes unit of the sheet 10. The fixing rod 32 has a vertical outer side at its lower half. Below the fixing rod 32, the pressing rod 33 is installed in parallel to the fixing rod 32 in such manner that it is able to lift up to press on the bottom of the fixing rod 32 or to push down away from the fixing rod 32. When a clean new bedclothes unit of the sheet 10 is pulled out from the delivery roller 20 via the delivery slit 31 to cover the mattress 40, the free end of the sheet 10 is extended along the inner side the fixing rod 32 and pulled outward through the space between fixing rod 32 and pressing rod 33. The pressing rod 33 is then lifted upward to press on the bottom of the fixing rod 32 and the free end portion of the sheet 10 so as to keep the free end portion of the bedclothes unit of the sheet 10 engaged between the fixing rod 32 and the pressing rod 33. While the user would like to replace an used bedclothes unit with another new bedclothes unit of the sheet 10, the pressing rod 33 is pushed downward to release the pressing force of the free end of the used bedclothes unit and the sheet 10 is pulled out until the next dividing line 11 of the sheet 10 reaches fixing rod 32, so that the new bedclothes unit of the sheet 10 is delivered to cover the mattress 40. Then, the pressing rod 33 is lifted upward again to press on the fixing rod 32 and the free end portion of the new bedclothes unit of the sheet 10 so as to keep the new bedclothes unit in position. Finally, the used bedclothes unit of the sheet 10 can easily be torn off along the vertical outer side of the fixing rod 32.

Figure 28:
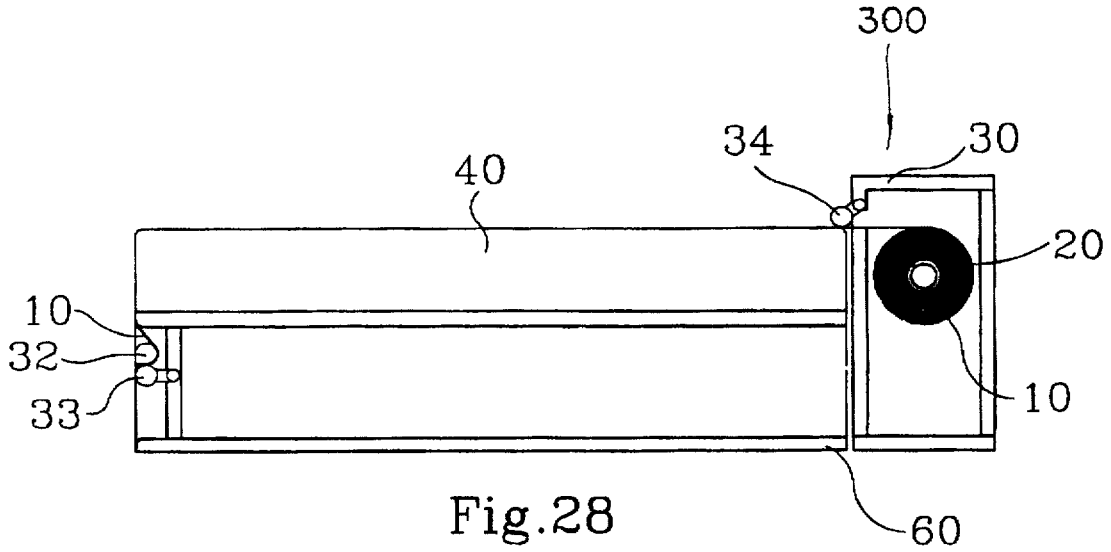
FIG. 28 is a perspective elevation view according to the above seventeenth embodiment of the present invention which further has a pressing rod mounted to the bedside housing.

Referring to FIG. 28, it illustrates another modification of the aforesaid seventeenth embodiment of the present invention. The delivery device 300 further comprises a delivery pressing rod 34 mounted along the delivery slit 31 of the bedside housing 30 in such manner that the delivery pressing rod 34 can be turned to various positions for catching and releasing the sheet 10 to prevent the continuous sheet 10 from further delivering after the mattress 40 is set.

Figure 29:
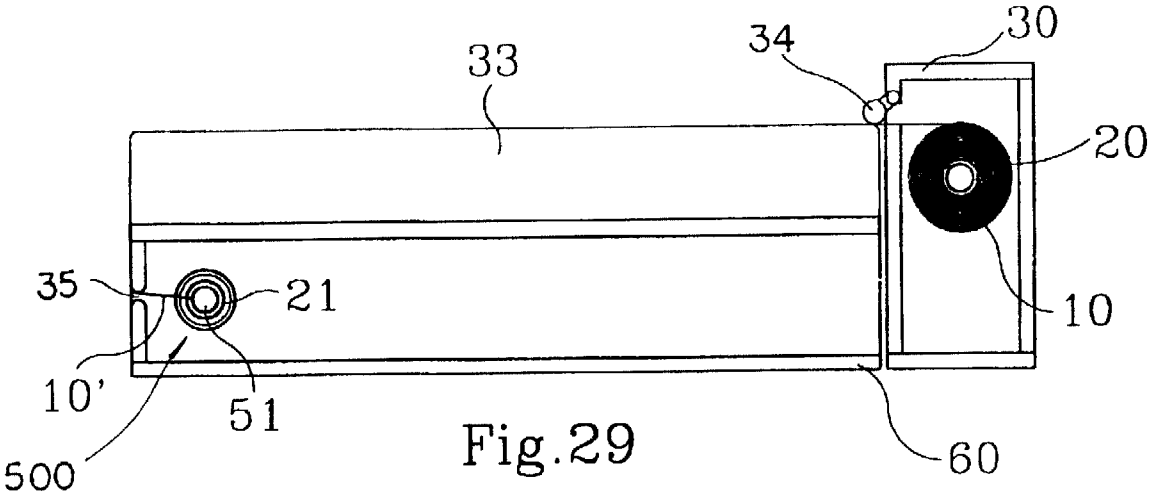
FIG. 29 is a perspective elevation view according to a preferred eighteenth embodiment of the present invention which further has a receiving roller.

Referring to FIG. 29, a continuous bedclothes apparatus according to a preferred eighteenth embodiment of the present invention is illustrated, which is an alternative mode of the seventeenth embodiment as shown in FIG. 26 and further comprises a receiving device 500. The receiving device 500 comprises two supporting axles 51 mounted to the two sides near the far end of the bedstead for supporting a receiving roller 21 inside the bedstead. The two supporting axles 51 have the similar configuration as shown in FIGS. 18 and 19. The far end of the bedstead has a receiving slit 35 parallel to the receiving roller 21 for the incoming of the used long sheet 10' to roll onto the receiving roller 21.

Figure 30:
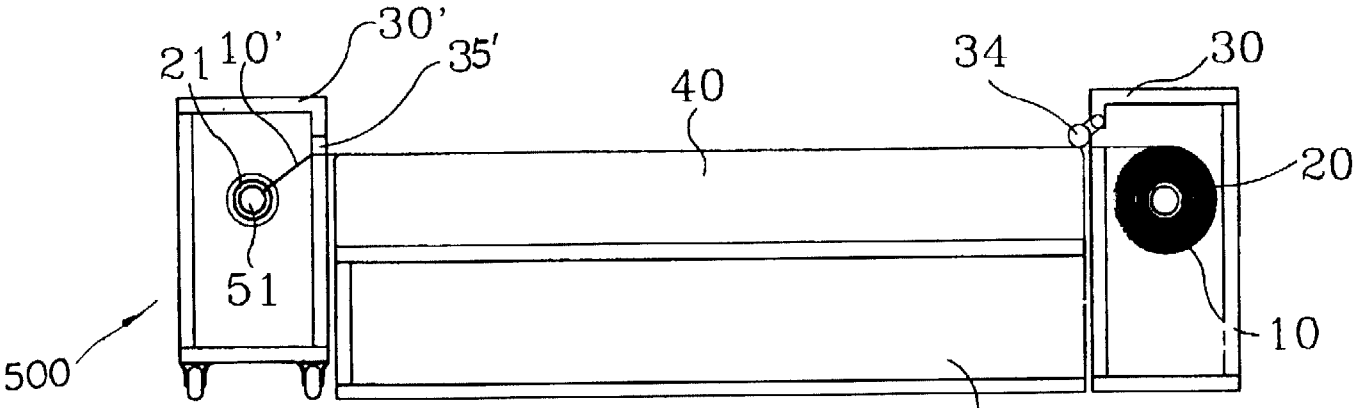
FIG. 30 is a perspective elevation view according to a preferred nineteenth embodiment of the present invention which further has a receiving device.

Referring to FIG. 30, a continuous bedclothes apparatus according to a preferred nineteenth embodiment of the present invention, which is a modification of the aforesaid eighteenth embodiment shown in FIG. 29. The receiving device 500 further comprises a bedside receiving housing 30' which has a receiving slit 35' at its upper portion for the incoming of the used long sheet 10' to toll onto the receiving roller 21 mounted between the two receiving supporting axles 51.

Figure 31:
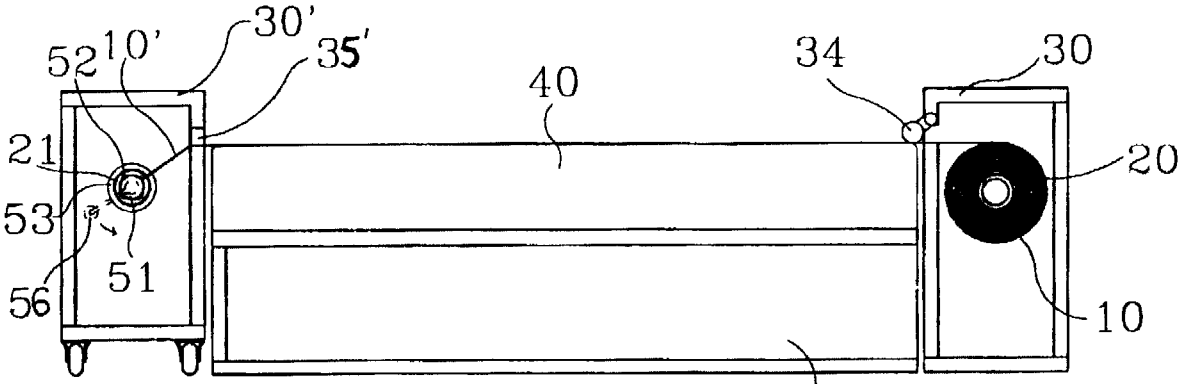
FIG. 31 is a perspective elevation view according to a preferred twentieth embodiment of the present invention in which the receiving device has a rotation handle.

Referring to FIG. 31, a continuous bedclothes apparatus according to a twentieth embodiment of the present invention is illustrated, which is a modification of the above nineteenth embodiment shown in FIG. 30. The pair of receiving supporting axles 51 are installed in the bedside receiving housing 30' by means of a pair of axial holders 52 respectively. Each receiving supporting axle 51 has a plurality of longitudinal tenons 53 on its shaft. A rotation handle 56 is installed on the external part of one of the receiving supporting axles 51. The tenons 53 are fit into corresponding longitudinal indentions provided on the receiving roller 21. Used bedclothes units of the sheet 10' are rolled onto the receiving roller 21 by turning the rotation handle 56 manually. The used sheet 10 is rotated to the dividing lines 11 and separated. The clean new bedclothes unit of sheet 10 is pulled out to cover the mattress 40 of the bed.

Figure 32:
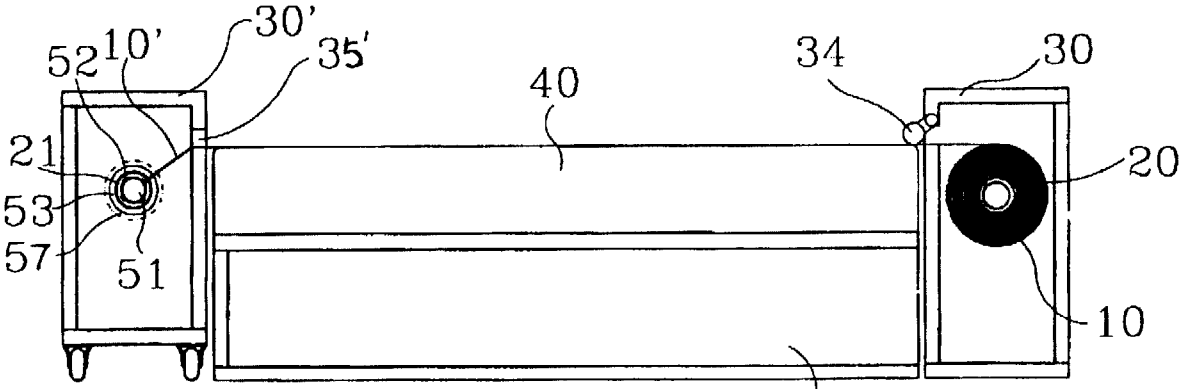
FIG. 32 is a perspective elevation view according to a preferred twenty-first embodiment of the present invention in which the receiving device has a motor.

Referring to FIG. 32, a continuous bedclothes apparatus according to a preferred twenty-first embodiment of the present invention is illustrated, which is an alternative mode of the above twentieth embodiment, wherein the rotation handle 56 is substituted by a driving motor 57 which is connected to one of the receiving supporting axles 51 becoming an extended shaft of the driving motor 57. Therefore, used bedclothes units of the sheet 10' are able to roll automatically onto the receiving roller 21 by the rotation of the motor 57.

There are a plurality of alternative modes of the delivery device 300 according to various kinds of configuration of the continuous sheet 10 as disclosed above.

Figure 33:
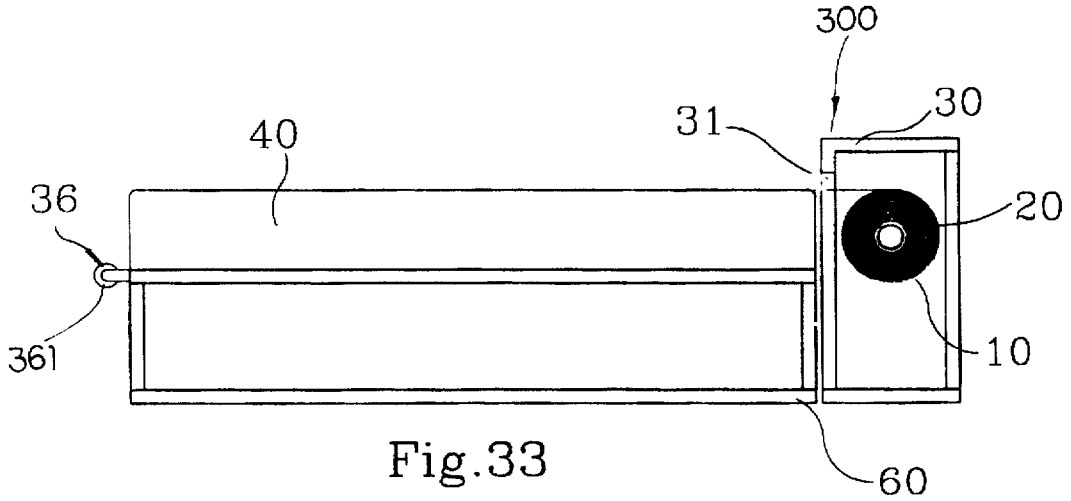
FIG. 33 is a perspective elevation view a preferred twenty-second embodiment of the present invention, illustrating the disposition of the continuous bedclothes device in a bedside housing and having a reversing stand.
Figure 34:
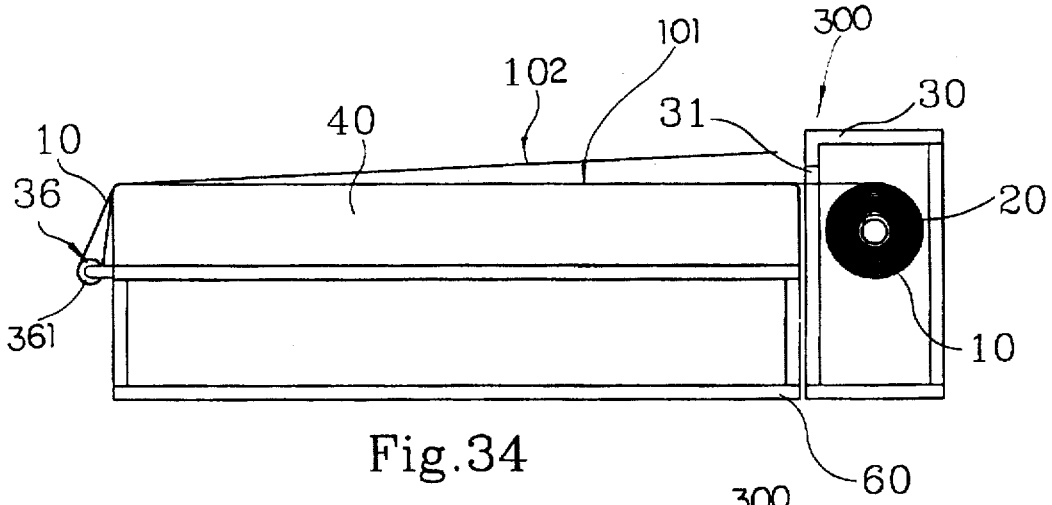
FIG. 34 is an operational perspective elevation view the above twenty-second embodiment of the present invention.

Referring to FIG. 33, a preferred twenty-second embodiment of the present invention which is a modification of the aforesaid seventeenth embodiment shown in FIG. 26 is illustrated. The delivery device 300 further comprises a reversing stand 36 having a long reversing roller 361 mounted thereon. Such device is specifically accommodated to a single layer of long sheet 10 which has a plurality of bedclothes units having a length double the length of the mattress 40 and the bedclothes units are also divided by the dividing lines 11 intervally. At the middle position between the two dividing lines 11 of every bedclothes unit has a folding line 12, as shown in FIG. 9 which illustrates the sixth embodiment of the present invention. As shown in FIG. 34, therefore, each bedclothes unit of the long sheet 10 can be pulled out from the delivery roller 20 within the delivery device 300 to cover the top surface of the mattress 40 to form a lower layer acting as a bedsheet 101 and then turn over at the folding line 12 by the reversing roller 361 of the reversing stand 36 to form an upper layer acting as a bedspread 102. To change the bedclothes, it is only required to pull out a new bedclothes unit of the sheet 10 and make it cover the mattress 40 and the used bedclothes unit of the sheet 10 can simply be torn off along the next dividing line 11.

Figure 35:
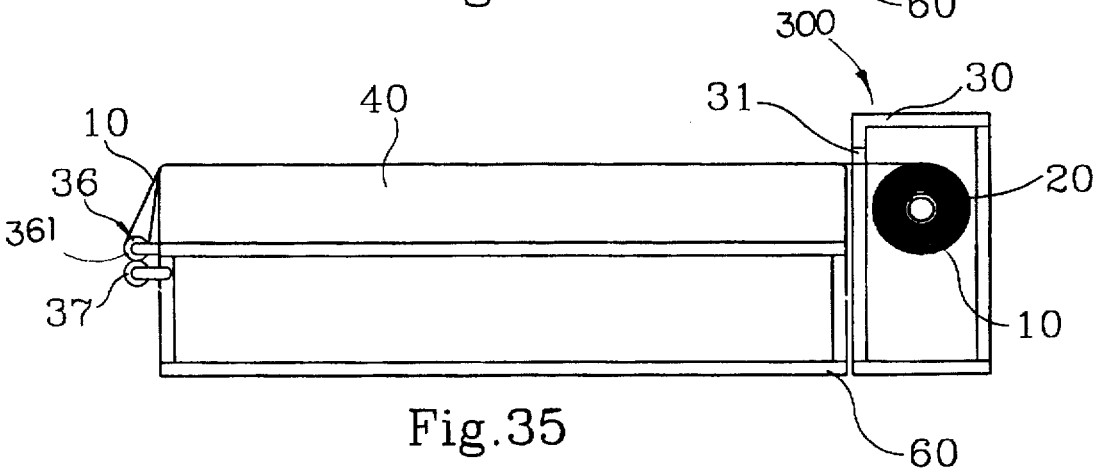
FIG. 35 is a perspective elevation view a preferred twenty-third embodiment of the present invention, illustrating the disposition of the continuous bedclothes device in a bedside housing and having a receiving stand and a delivery pressing stand.

A preferred twenty-third embodiment is illustrated in FIG. 35 which is an alternative mode of the above twenty-second embodiment. The delivery device 300 further comprises a delivery pressing stand 37 installed beneath the reversing stand 36 in such manner that the delivery pressing stand 37 is able to lift upward to press on the bottom of the reversing stand 36 or to push downward away from the delivery pressing stand 37. When the delivery pressing stand 37 is set at its upward position to press on the folding line 12 of the sheet 10, the sheet 10 is kept firmly between the reversing stand 36 and the delivery pressing rod 37 and cannot be pulled out further.

Figure 36:
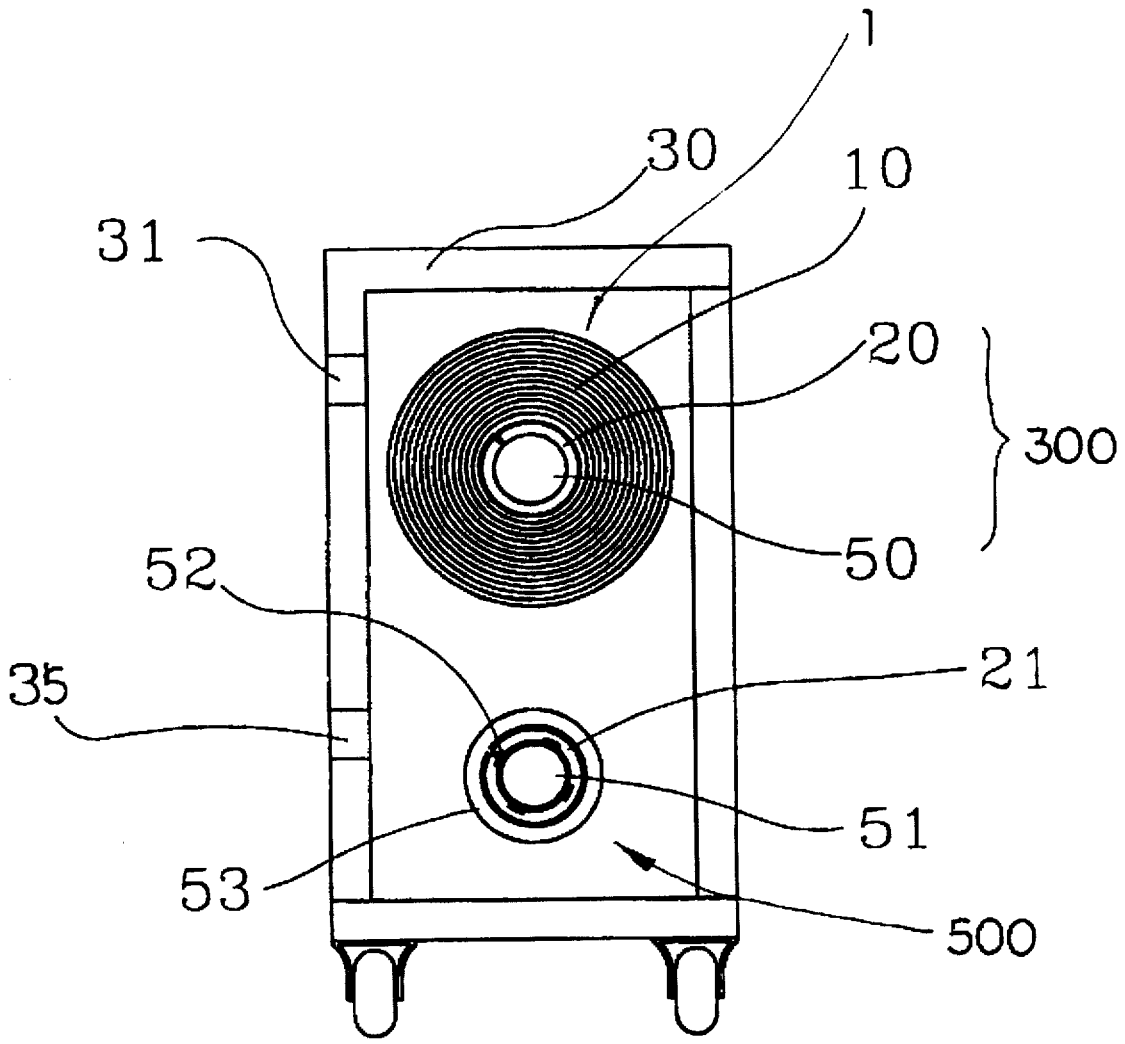
FIG. 36 is a perspective elevation view of a continuous bedclothes apparatus installed in a movable housing according to a preferred twenty-fourth embodiment of the present invention.

Referring to FIG. 36, a continuous bedclothes apparatus according to a preferred twenty-fourth embodiment of the present invention is illustrated. The continuous bedclothes apparatus comprises a continuous bedclothes device 1 having a delivery device 300 and a receiving device 500 installed within a housing 30 which has a delivery slit 31 and a receiving slit 35 transversely disposed on the upper portion and the lower portion of one side of the housing 30 respectively. The housing is a movable cabinet on rollers so that such movable delivery and receiving devices for continuous disposable and recyclable bedclothes can be moved from bed to bed for changing bedclothes.

The continuous bedclothes device 1 includes an elongated sheet 10 which is made of disposable and recyclable material such as durable elastic paper, knitting tissue, compressed tissue or paper clothe, etc. and has a width equal to the length of the delivery roller 20. One end of the sheet 10 is attached to the delivery roller 20 and the sheet 10 is rolled on the delivery roller 20. Various kinds of the continuous sheet 10 of the continuous bedclothes device 1, as shown in FIGS. 1, 5, 6, 7, 9, 10, and 12, are able to utilize in this embodiment.

The delivery device 300 includes a pair of supporting axles 50 which are affixed to two opposite sides of the housing 30 so as to support the delivery roller 20 in rotary manner and parallel to the slit 31.

The receiving device 500 comprises a receiving roller 21 which is held by a pair of receiving supporting axles 51 (as shown in FIGS. 18 and 19) which are installed to the lower two parallel sides of the housing 30. The receiving roller 21 are mounted between the pair of receiving supporting axles 51 in such manner that it is able to rotate manually or by electricity. Each of the supporting axles 51 is installed on a holding bearing 52 and has a plurality of longitudinal tenons 53 on its shaft. The tenons 53 are fit into corresponding indentions provided on the receiving roller 21. Therefore, used bedclothes units of sheet 10 are rolled onto the receiving roller 21 via the receiving slit 35 by taming the receiving roller 21.

I claim:

1. A bed apparatus, comprising a continuous bedclothes device which includes:

an elongated sheet and a delivery roller, said elongated sheet is made of disposable and recyclable material having one end attached to said delivery roller, said elongated sheet comprising an upper layer and a lower layer rolled onto said delivery roller, said upper layer and said lower layer respectively having a plurality of dividing lines spaced transversally, parallelly and evenly thereon for dividing said upper layer and said lower layer to form a plurality of symmetrical upper bedclothes units and lower bedclothes units respectively, wherein said dividing lines are transversely crack lines that each of said bedclothes units is attach to one another with a tension enough to connect said plurality of bedclothes units to form said elongated sheet, so that when a manual tearing force is applied to one of said dividing lines between two of said upper bedclothes units and one of said dividing lines between two of said lower bedclothes units, one of said upper bedclothes units and one of said lower bedclothes units are able to be torn off from another of said upper bedclothes units and another of said lower bedclothes units, and that when said elongated sheet is unrolled from said delivery roller for covering a mattress, each of said upper bedclothes units forms a bedspread and each of said lower bedclothes unit forms a bedsheet for covering a mattress; and a delivery device including a housing and a pair of supporting axles, said housing includes a delivery slit adapted for delivering said elongated sheet via said delivery slit, said pair of supporting axles being respectively installed to two opposite sides of said housing so as to support said delivery roller in a rotary manner and parallel to said delivery slit, wherein said mattress is placed on a bedstead and said housing is located adjacent to said mattress to form a bedside cupboard, said delivery slit being transversally disposed on an upper portion of a bed side of said housing and said delivery roller being mounted inside said housing and parallel to said delivery slit by means of said pair of supporting axles, said delivery device further comprising a delivery pressing rod, a fixing rod and a pressing rod, said delivery pressing rod being mounted along said delivery slit of said housing in such a manner that said delivery pressing rod is capable of operating to an upper releasing position to enable delivering said elongated sheet and to a lower position for catching said elongated sheet to prevent said elongated sheet from further delivering, said fixing rod and said pressing rod being affixed to a far end of said bedstead opposite said delivery device for facilitating a separation of said upper bedclothes unit and said lower bedclothes unit of said elongated sheet, said pressing rod is installed in parallel with said fixing rod and being capable of selectively lifting up to press on a bottom of said fixing rod and pushing down away from said fixing rod, so that when said elongated sheet including one of said upper bedclothes units and one of said lower bedclothes units is pulled out from said delivery roller via said delivery slit for covering said mattress, a free end of said elongated sheet is extended along an inner side of said fixing rod and pulled outwards through a space provided between said fixing rod and said pressing rod while said pressing rod is pushed downwards, and then said pressing rod is lifted upwards to press on a bottom of said fixing rod and said free end of said elongated sheet so as to keep said free end of said elongated sheet engaged between said fixing rod and said pressing rod.

2. A continuous bedclothes apparatus, as recited in claim 1, wherein each of said supporting axles is installed on a holding bearing, each of said supporting axles having an extended end to which a rotation handle is installed thereto, each of said rotation handles is capable of pulling out to adjust a length of said respective supporting axle for mounting said delivery roller.

* * * * *